US005713581A

United States Patent [19]

Carlson et al.

[11] Patent Number: 5,713,581

[45] Date of Patent: Feb. 3, 1998

[54] FIBROUS SEAL FOR BLOWOUT PREVENTER

[75] Inventors: Douglas W. Carlson; Stephen P. Simons; William D. Breach, all of Kingwood, Tex.

[73] Assignee: Hydril Company, Houston, Tex.

[21] Appl. No.: 604,264

[22] Filed: Feb. 21, 1996

Related U.S. Application Data

[63] Continuation of Ser. No. 316,923, Oct. 3, 1994, abandoned.

[51] Int. Cl.[6] ..... F16J 15/02

[52] U.S. Cl. ..... 277/188 R; 277/227; 251/1.2

[58] Field of Search ..... 277/188 R, 188 A, 277/227, 233, DIG. 6; 251/1.1, 1.2, 1.3

[56] References Cited

U.S. PATENT DOCUMENTS

| | | | |
|---|---|---|---|
| 2,746,710 | 5/1956 | Jones | 251/1.3 |
| 3,879,044 | 4/1975 | Estes | 277/227 |
| 3,918,726 | 11/1975 | Kramer | 277/227 |
| 4,506,858 | 3/1985 | Gentry | 251/1.3 |
| 4,553,730 | 11/1985 | Vicic | 251/1.3 |
| 4,700,954 | 10/1987 | Fischer | 277/227 |
| 5,028,056 | 7/1991 | Bemis et al. | 277/227 |
| 5,256,223 | 10/1993 | Alberts et al. | 277/227 |
| 5,294,088 | 3/1994 | McWhorter et al. | 251/1.3 |
| 5,351,973 | 10/1994 | Taniuchi et al. | 277/227 |
| 5,405,467 | 4/1995 | Young et al. | 251/1.3 |

OTHER PUBLICATIONS

Hydril Tech Brief 0020, Mechanical Products, Jul. 1981.

Hydril Engineering Bulletin 93008, Hydril 18 ¾—10,000 & 15,000 Shear Ram Lateral T-Seal, 21 Jul. 1993.

*Primary Examiner*—Scott Cummings

*Attorney, Agent, or Firm*—Vaden, Eickenroht and Thompson, L.L.P.

[57] ABSTRACT

A high pressure seal material, such as for a lateral "T" seal of a shear ram blowout preventer, is disclosed wherein the seal material is preferably nitrile rubber and includes uniformly dispersed synthetic, non-cellulosic fibers in parallel alignment to resist rollover action occurring transverse to the applied compressive force by orienting the aligned fibers parallel to the axis of the applied force. The material is made in a milling process that aligns and maintains the alignment of the fibers. The milled sheet is then cut into appropriately shaped pieces. The pieces are rotated 90°, plied and cured to make the final material, which curing can be done in a suitable mold so that the final product is in its desired final shape.

7 Claims, 5 Drawing Sheets

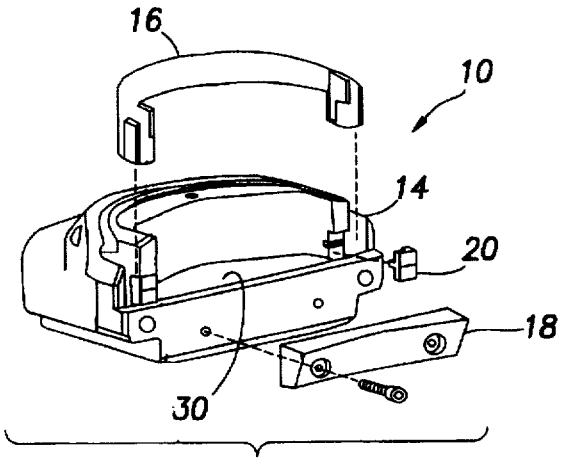
FIG. 1A
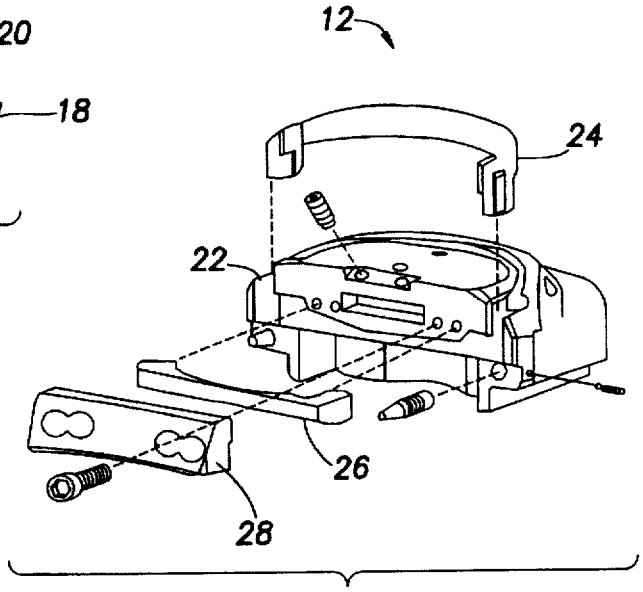
FIG. 1B
FIG. 2A
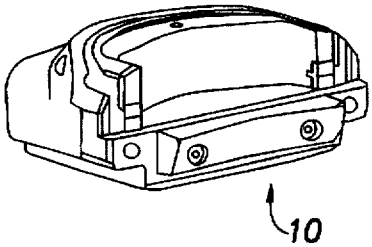
FIG. 2B
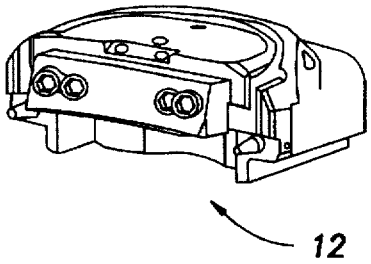
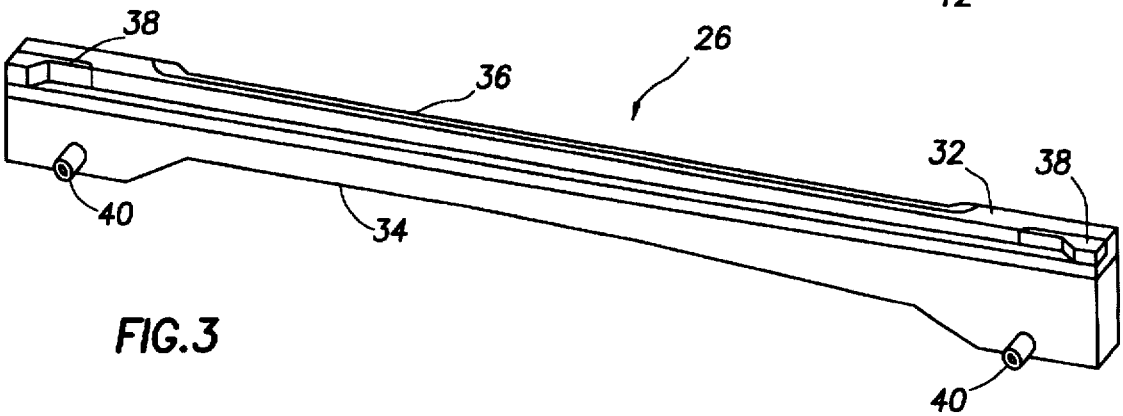
FIG. 3

10
12
42
26
F

FIG.6
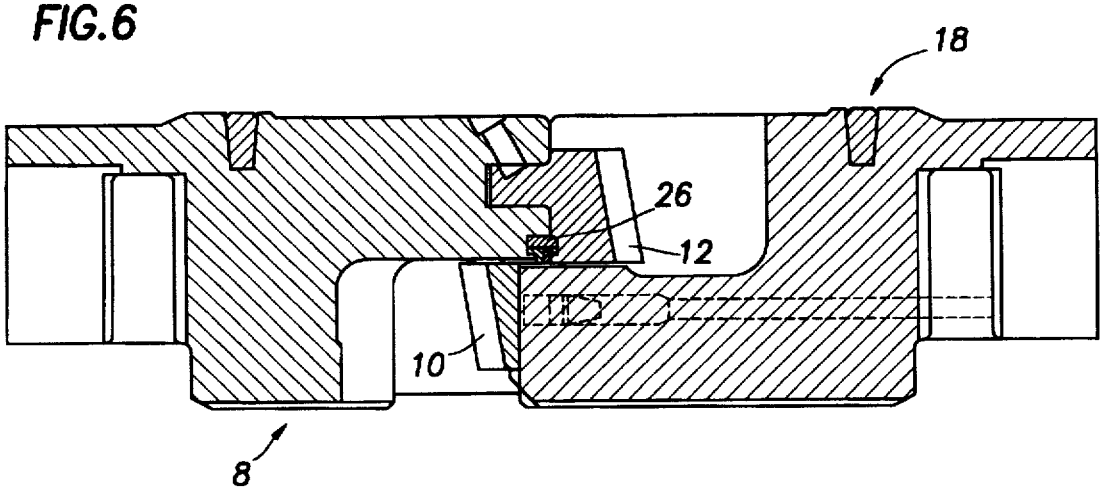
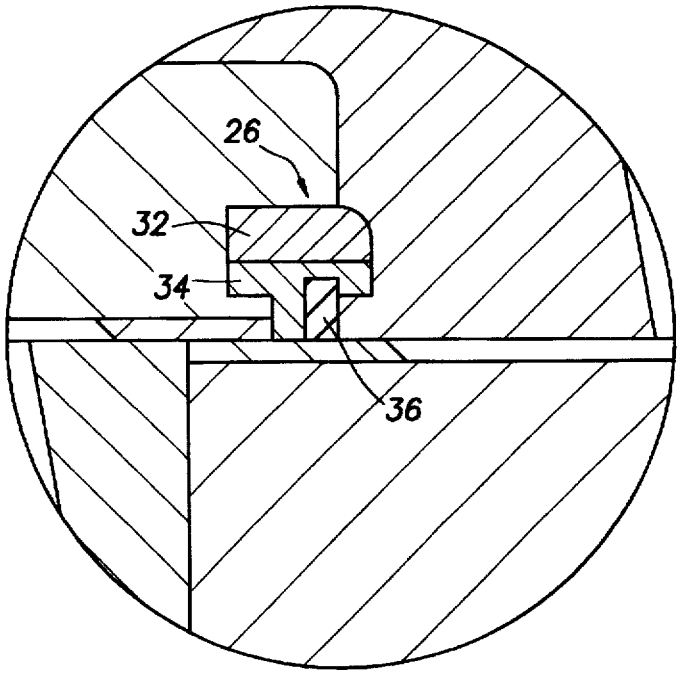
FIG.7

FIG.8
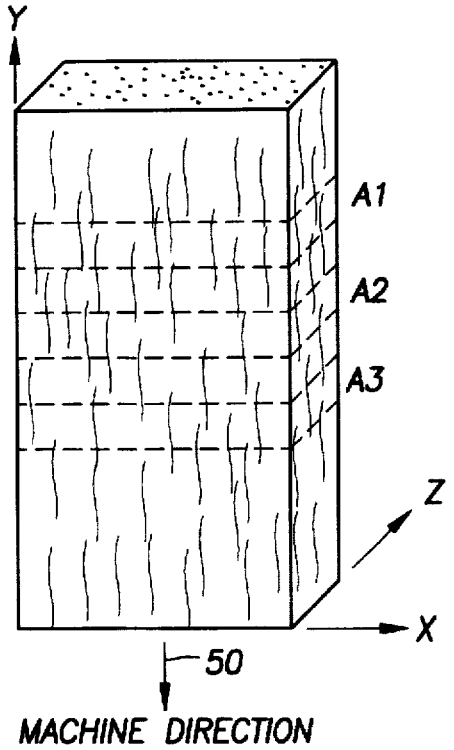
FIG.9
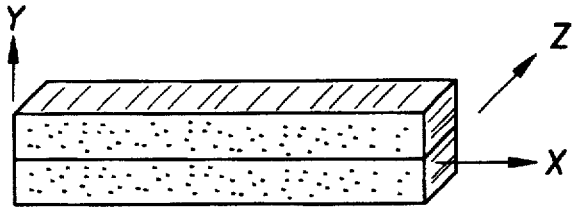
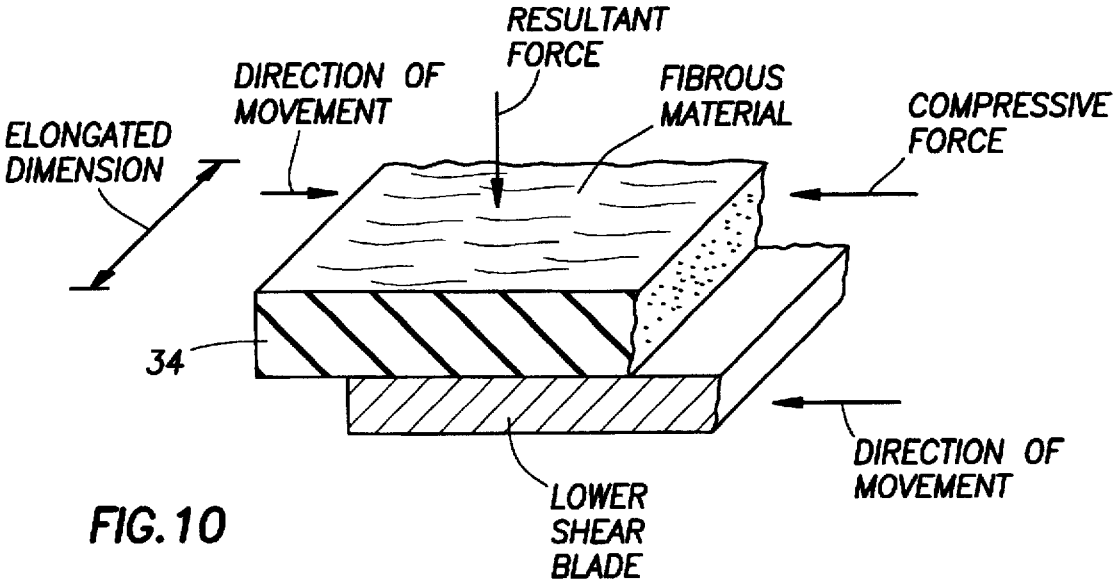
FIG.10

FIBROUS SEAL FOR BLOWOUT PREVENTER

This application is a continuation of application Ser. No. 08/316,923, filed Oct. 3, 1994, now abandoned.

BACKGROUND OF THE INVENTION

1. Field of the Invention

This invention pertains to improved seals for use in wellhead blowout preventers, and particularly for use in a shear ram blowout preventers, wherein the material includes pre-aligned fibers oriented to maximize the operating life of the seals.

2. Description of the Prior Art

A blowout preventer generally is used to close off the annulus or open hole of an oil or gas well when a blowout threatens. That is, a blowout preventer permits closure and seal off of anything in the bore hole including drill pipe, kelly, tool joints, and tubing. A shear ram blowout preventer is designed to shear the drill pipe that is present and seal the bore hole.

Generally, the shearing operation occurs in adverse conditions and under high pressures, requiring high pressure ram action significantly greater than the elevated well pressure to first flatten the pipe, then shear or cut the pipe and, finally, to seal the bore hole. A shear ram blowout preventer utilizes two opposing ram assemblies, each with a blade mounted in a carrier assembly moved by a ram operating transverse to the bore hole and the drill pipe that is to be severed. In operation, one carrier assembly, referred to as the upper blade carrier assembly, operates so that its blade passes over the opposing blade of the other carrier assembly, referred to as the lower blade carrier assembly. The upper blade is designed to pass in close proximity over the lower blade as it approaches the fully closed position to cause the shearing to occur. This is much like the action of scissors.

The upper blade carrier assembly includes a lateral "T" seal in a groove located behind the upper shear blade. When the carrier assemblies move together, the lateral "T" seal is energized so that the center portion thereof is forced down to create a seal on the top a hard metal sealing surface of the lower carrier.

The "T" seal is generally elongated and primarily comprises two contrasting resilient pieces bonded together. The upper section of the "T" seal is made of a flexible rubber or similar material that allows an extrusion feed toward the center portion. The lower section of the "T" seal is made of durable and abrasion-resistant tough rubber or similar elastomer material that is harder than the upper section of the seal to which it is bonded. As the seal is formed in its operating mode, although made of tough, hard material, the lower section, nevertheless, tends to roll on an axis parallel with its longest dimension, which is transverse to both the axis of the bore hole and the operating axis of the rams. It may be evident that the life of the material is dependent on its resistance to this tendency to rollover.

Although various materials have been employed for forming the lower section or portion of a lateral "T" seal, heretofore, among the most successful materials has been a nitrile rubber having dispersed therein a randomly distributed synthetic fiber such as Nomex®. Although tough, the duration or durability of this material has not been fully satisfactory, necessitating replacement of the seal more frequently than desired.

Therefore, it is a feature of the present invention to provide an improved structure made from materials similar to those used in the past, but combined in such a manner so that the resulting structure displays improved dimensional and mechanical stability, greater durability, and consequently, improved life.

It is another feature of the present invention to provide an improved seal, especially a lateral "T" seal for a shear ram blowout preventer, that has fibers aligned therein to resist the primary direction of wear on the seal and, therefore, increases the life of the seal by about 50 percent.

It is still another feature of the present invention to provide an improved method of making a thick high pressure elastomeric or rubber seal having dispersed therein synthetic fibers such that the fibers are aligned parallel to each other and axially oriented so as to resist stretching in a first direction, while enhancing stretching in another direction, contrary to the ordinary propensity of a similarly shaped seal not having such parallel aligned and axially oriented fibers.

SUMMARY OF THE INVENTION

The high pressure seal of the present invention, which in the preferred embodiment is exemplified by a lateral "T" seal employed in a shear ram blowout preventer, is made of nitrile or other similar resilient or elastomeric material. The primary direction of stretch of the seal is predetermined by its application. In the case of a lateral "T" seal employed in a shear ram blowout preventer, the stretch is transverse to the axis of the ram movement or action. The frictional forces operating on the two adjacent and oppositely moving metal blades tend to cause the highly energized seal to rollover in the direction of ram movement. To counter this tendency, preferably non-cellulosic fibers are embedded in the material aligned and oriented parallel to the ram axis or movement. Thus, when the seal is encountered by the moving frictional forces as above described, instead of tending to rollover, the seal stretches in an accordion fashion. This latter type of stretching is a more wear-resistant type of stretching than is the rollover type of stretching.

In order to produce a seal of the above-described type, the nitrile rubber or other similar material is suitably milled with the fibers scattered therein to produce a relatively thin sheet of material. The uni-directional milling operation assures that the fibers are oriented primarily in the direction the sheet moves during milling. The sheet is subsequently cut into pieces having the desired shape and the pieces then are stacked or plied to the desired thickness. The resulting structure is cured to form a coherent mass with the fibers oriented and uniformly distributed throughout. The desired shape of the lateral "T" seal or other high pressure seal is determined either by curing in the proper shaped mold or by subsequent die or other cutting of the material.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the drawings illustrate only preferred embodiments of the invention and are therefore not to be considered limiting of its scope as the invention may admit to other equally effective embodiments.

In the drawings:

FIG. 1 is an exploded pictorial view of the upper blade carrier assembly and lower blade carrier assembly of a shear ram blowout preventer in which a lateral "T" seal is employed in accordance with the present invention.

FIG. 2 is the pictorial assembled view of the upper blade carrier assembly and lower blade carrier assembly shown in FIG. 1.

FIG. 3 is a pictorial view of the lateral "T" seal employed in the upper blade carrier assembly shown in FIGS. 1 and 2.

FIG. 6 is a cross-sectional view of closed shear rams.

FIG. 7 is a close-up cross-sectional view of the lateral "T" seal of the shear rams shown in FIG. 6.

FIG. 8 is an oblique view of plied layers of elastomeric and fibrous material in accordance with a step in the making of a preferred embodiment of a seal in accordance with the present invention.

FIG. 9 is an oblique view of plied layers of the material shown in FIG. 8 in a subsequent step of manufacture.

FIG. 10 is a fragmentary cross-sectional view of an elastomeric seal material in accordance with the present invention in use in an upper ram of a shear ram blowout preventer and showing its relation with respect to the top surface of the lower shear blade of the lower ram of the shear ram blowout preventer.

DESCRIPTION OF THE PREFERRED EMBODIMENTS

Figures 4A, 4B, 4C, 4D:
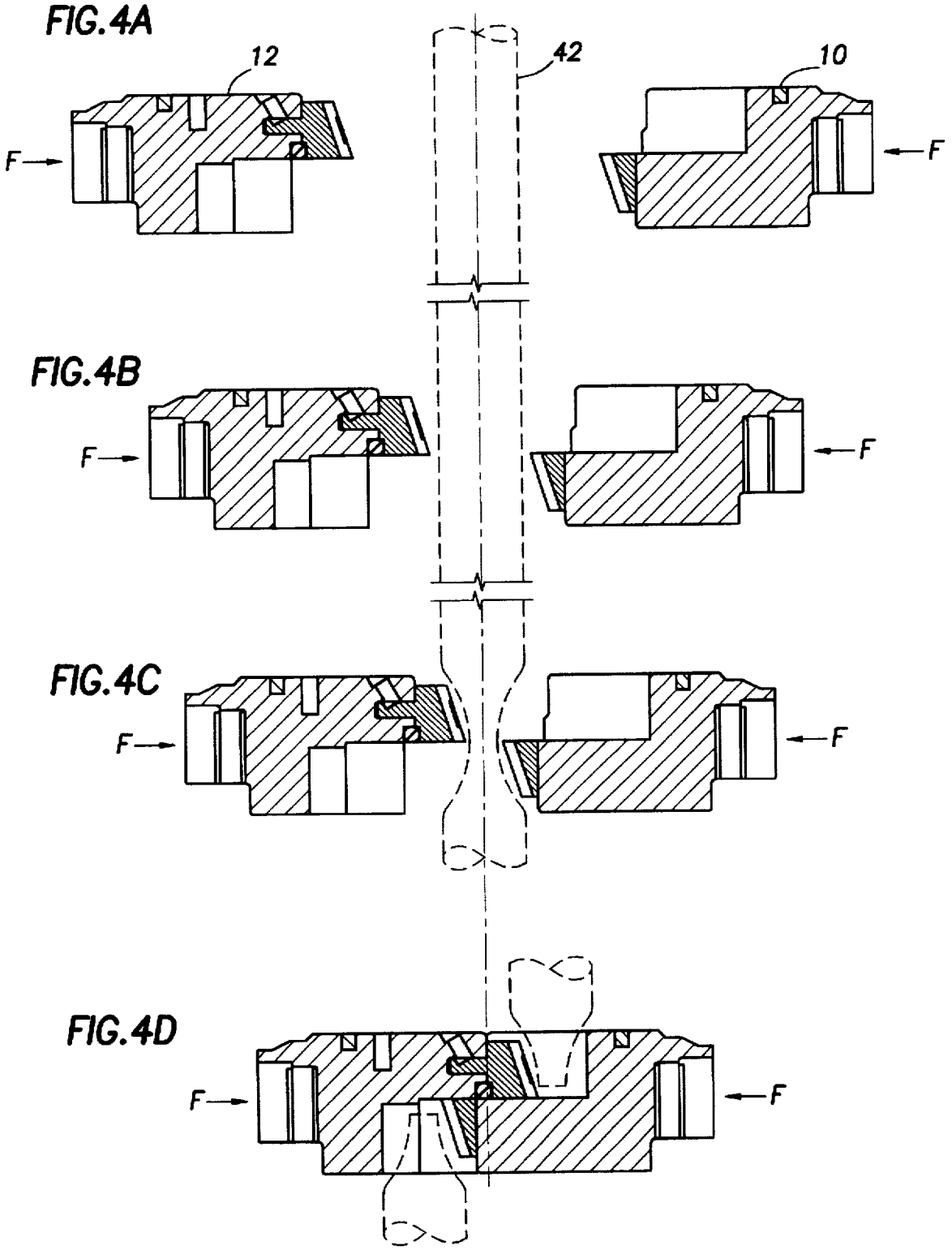
FIG. 4 is a step-by-step frontal view illustration of shear rams operating in conjunction with a drill pipe.

Now referring to the drawings, and first to FIG. 1, the upper and lower blade carrier assemblies 10 and 12, respectively, of a shear ram blowout preventer are shown in exploded pictorial views. Generally, lower blade carrier assembly 10 comprises a lower blade carrier 14, an upper seal 16, a lower shear blade 18 and anti-extrusion blocks 20. The lower shear blade is conveniently bolted to the lower blade carrier to permit the lower shear blade to be removed to be sharpened or replaced. The anti-extrusion blocks are provided to prevent the seals to be extruded from their respective grooves during use since the seals undergo an immense amount of pressure under shearing conditions, as hereafter described. In fact, blocks 20 actually assure that the extrusion action is toward the lateral "T" seal of the upper blade carrier assembly, as hereinafter explained. The assembled lower blade carrier assembly 10 is shown in FIG. 2.

In similar fashion upper blade carrier assembly 12 comprises upper blade carrier 22, an upper seal 24, a lateral "T" seal 26, and upper shear blade 28. Thus, a lateral "T" seal only exists in the upper blade carrier assembly, not in the lower blade carrier assembly. The assembled upper blade carrier assembly 12 is also shown in FIG. 2, wherein it is apparent that the cutting edge of upper shear blade 28 is located to pass over the top of lower shear blade 18 and the adjacent Stellite sealing surface 30 of lower blade carrier 14.

As shown in FIG. 3, lateral "T" seal 26 is a complex structure made up of two different types of nitrile rubber compounds, one for upper elastomer portion 32 and another for lower elastomer "T" portion 34, respectively. Upper portion 32 is softer and a little more subject to extrusion pressure than is lower "T" portion 34, which is harder and tougher than portion 32. Nylon or other non-elastomeric plastic central anti-extrusion bar 36, anti-extrusion end pieces 38, and metal alignment pins 40 complete the parts of a typical lateral "T" seal. Thus, if lateral "T" seal 26 is rotated 180°, it would be in a position to fit into the upper carrier, as shown in FIG. 1. All pieces are suitable bonded to each other using adhesives appropriate to the application. Bonding agents that have been preferably employed are Chemlock 205 and Chemlock 220, which are products of Lord Elastomer Products of Erie, Pa. Other equivalent bonding agents can be used.

Figures 5A, 5B, 5C, 5D, 5E, 5F, 5G, 5H, 5I, 5J:
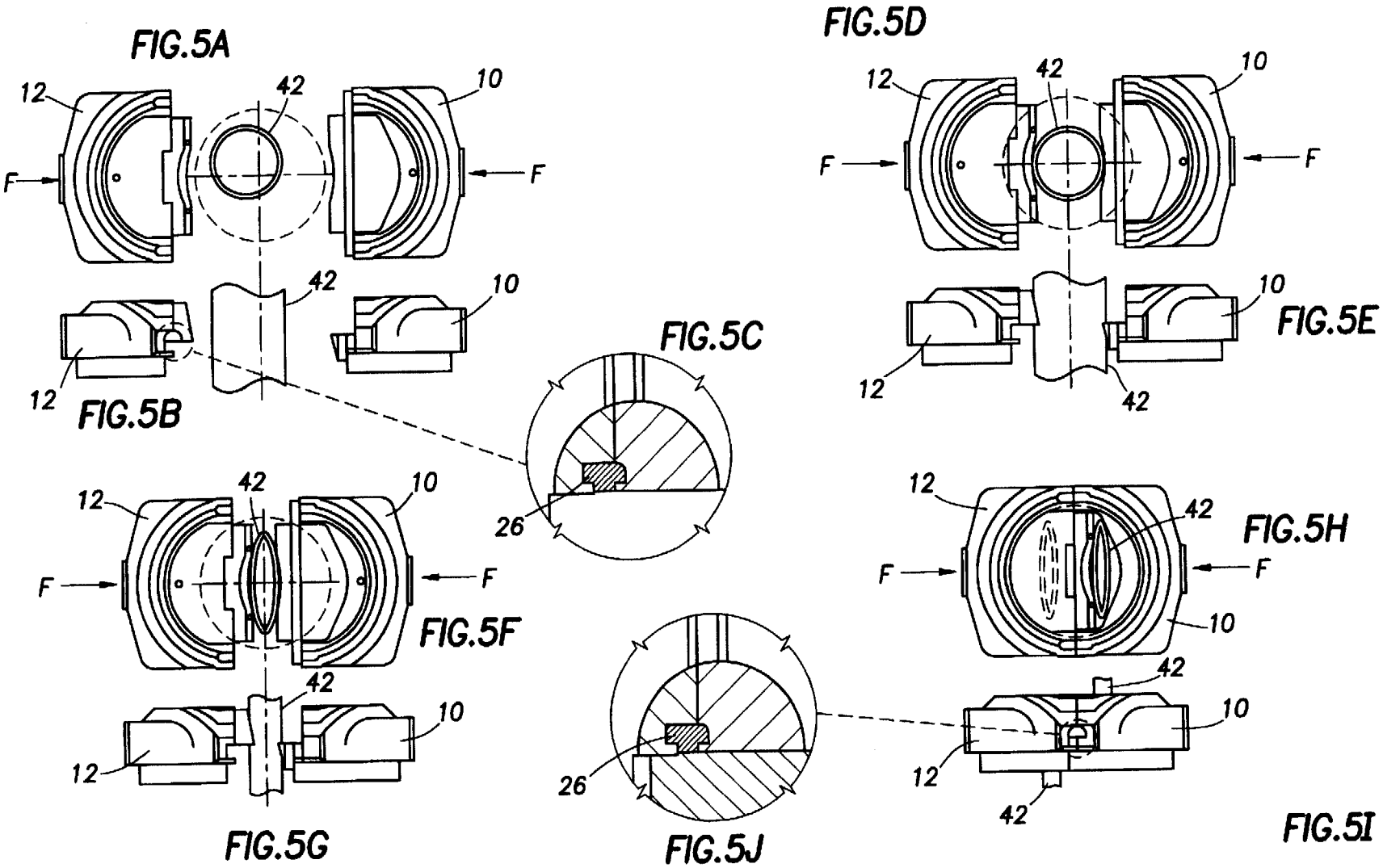
FIG. 5 is a step-by-step top view illustration of shear rams operating in conjunction with a drill pipe.

In operation of a shear ram type of blowout preventer, when conditions indicate that the opposing rams should be closed, the action occurs as shown in FIGS. 4 and 5. Turning first to FIG. 4, a drill pipe 42 to be sheared is shown in the central opening of the blowout preventer such that upper blade carrier assembly 12 is located on one side of drill pipe 42 and diametrically there opposite lower blade carrier assembly 10 is located with respect to drill pipe 42. The rams start forward motion along their respective axes to move the respective upper and lower blade carrier assemblies forward in the direction of arrows F, as shown in the top step. In the next step, the shear blades first touch drill pipe 42. In the third step, the drill pipe is flattened and pinched just prior to severing or shearing. In the final step, drill pipe 42 is sheared in two, the upper shear blade passing over the top of the lower shear blade.

The action of shearing is further shown in FIG. 5, wherein the top views and enlarged cross-sectional lateral "T" seal views are added to the side views. Thus, it is apparent that in step 1 of FIG. 5, the ram faces are uniformly located with respect to the central opening of the blowout preventers, depicted in dotted lines, but not necessarily with respect to drill pipe 42, which is often located off center therein. In step 2, the rams are moved into contact with pipe 42 to center the pipe.

Step 3 illustrates the mashing or pinching of drill pipe 42 preliminary to shearing. Thus, the pipe is collapsed to make the shearing action easier. In the final step, the rams are fully motivated to close the blade carrier assemblies with respect to each other. The "T" seal located in a groove behind the upper shear blade of upper blade carrier assembly 12 is slightly recessed with respect to the top surface of the projected passage of the lower blade, as shown in the blown up portion of step 1. The compressive forces in the direction of the arrows shown in steps 2, 3 and 4, which are also parallel to the direction of the moving rams, energize seal 26 so as to extrude the lower portion of seal 26 downward. As the lower blade passes beneath it, the frictional pressure on the contacted seal tends to cause the seal to rollover, a very wear-causing action of the material.

FIG. 6 better illustrates the closed position of the respective upper shear blade 12 and lower shear blade 10, with "T" seal 26 being located in a suitable groove in the upper blade carrier assembly. In the final position of the carrier assemblies, blade 10 has actually passed by "T" seal 26 to come to rest on a suitable sealing surface of the lower blade carrier behind blade 10.

As shown in a close up view in FIG. 7, "T" seal 26 is energized by the extrusion of the rubber sections, primarily that of top section 32. Lower section 34 of seal 26 tends to rollover the top surface of blade 10 and then the contiguous top surfaces of subsequent Stellite materials, while anti-extrusion piece 36 supports lower section 34 from the rear.

Now referring to FIG. 8, an improved structure is formed for producing a lateral "T" seal 26 by first, dispersing suitable elongated synthetic fibers of non-cellulosic materials throughout a mass of nitrile or other suitable rubber or the like. The rubber including the desired fiber is passed through a mill, thereby aligning the fibers parallel to each other with their major axes oriented in the direction of arrow 50, which is the direction of movement of the sheet through the mill. With respect to the illustrated X-Y axis, the fibers are aligned parallel to the Y axis. The milling further disperses the fibers within the material and accomplishes the parallel alignment and axial orientation of the fibers throughout the sheet.

After the milling step is completed and the desired thickness of the sheet is achieved, strips A1, A2, A3 and the like are cut from the sheet. Typically, the dimension of the sheet is 50"×10"×. 0.060" and the strips are 8–10" long and approximately ⅜" wide. The strips are then rotated 90° and plied or stacked together. It should be noted that plying can best be achieved by completely cutting through the sheet material to form individual strips and subsequent stacking of the rotated layers, rather than by folding the strips, as is apparent by FIG. 9.

It is noted that the stack of the seal material can be as thick as desired, but regardless, all of the fibers are uniformly dispersed throughout the material to form a coherent mass. The stack of sheet material is then suitably cured, which may be in a suitable mold to determine the final shape of the seal. Alternatively, the cured material can be cut, such as by die cutting, to its final desired shape.

The material does not deform in a high pressure seal application in accordance with the lateral "T" seal action previously described. Instead of tending to rollover in a direction of the applied compressive forces, the material tends to stretch or spread in an accordion fashion, which is a much less harsh action than is a rollover action. Thus, the material exhibits anisotropy in the desired direction.

Fibers that have been successfully employed as above described include an aramid fiber poly-(p-phenyleneteraphthalamide) designated with the Kevlar® trademark, a dupont product. Such fibers, also known as aromatic polyamides, desirably undergo fibrillation during incorporation into the elastomer. Nitrile rubber is the preferred elastomer, although other suitable elastomers include hydrogenated nitrile and epichlorohydrin rubber. Also, non-oil resistant elastomers such as SBR or NBR, can be used. Other fibers such as nylon, polyester, polyacrylonitrile and the like can also be used, if desired, however, these fibers exhibit less fibrillation than the fibers previously described. In some cases, cellulosic fibers can be employed.

Other elastomers that can be used for the base material instead of nitrile include neoprene and a nitrile and neoprene combination compound. High pressure seals employed in other blowout preventer applications and in high pressure application, in general, can be made in accordance with the above description.

As shown in FIG. 1, an elastomeric T-seal 26 is located behind upper shear blade 28 in an upper ram block carrier of a shear ram blowout preventer. FIG. 10 is a fragmentary cross-sectional view that shows a part of such an elastomeric seal, namely, lower section 34, after it has come into physical contact with the top surface of the lower shear blade. The illustration shows that the elongated dimension of section 34 is generally into the page, as shown on the left side of the drawing, and that section 34 is moving transversely to such elongated dimension or generally from left to right, as shown by a direction arrow. The lower shear blade is moving from right to left, also as shown by a direction arrow. This produces a compressive force on lower seal section 34 in a direction parallel to the direction of movement, which is also parallel to the movement of the respective rams. This, in turn, produces a resultant force vertically downward into the face of the lower shear blade to produce the desired sealing action. Ordinarily, this would produce a tendency for the elastomeric seal material to rollover along a line transverse to the direction of the compressive force. However, since the elongated fibers dispersed throughout the elastomeric seal material are primarily oriented to be parallel to the direction of the compressive force, there is a strong resistance to such rollover. Instead, the material begins to spread apart accordion-fashion, which is much less harsh than rollover action, and, therefore, also greatly increases the life of the elastomeric seal material over a like material having randomly dispersed fibers.

Although the above description sets forth the preferred embodiment of the invention, and many alternatives have been discussed, further alternatives within the scope of the invention will be apparent to those of ordinary skill in the art.

What is claimed is:

1. In combination with an upper block carrier of the upper ram of a shear ram blowout preventer, an improved "T" seal subassembly that moves in a direction parallel with the movement of the upper ram, including an elastomeric coherent mass of material, and non-woven elongated fibers dispersed throughout said mass primarily oriented in a direction parallel to the movement of the upper ram.

2. The improved lateral "T" seal subassembly in accordance with claim 1, wherein said mass of material is a nitrile rubber.

3. The improved lateral "T" seal subassembly in accordance with claim 1, wherein said fibers are substantially uniformly dispersed through out said mass of material.

4. The improved lateral "T" seal subassembly in accordance with claim 1, wherein said fibers are non-cellulosic fibers.

5. The improved lateral "T" seal subassembly in accordance with claim 4, wherein said fibers are formed from a polymer chosen from the group consisting of aromatic polyamides, polyesters and polyacrylonitriles.

6. The improved lateral "T" seal subassembly in accordance with claim 5, wherein the polymer is the aromatic polyamide poly-(p-phenyleneteraphthalamide).

7. An elastomeric seal that is subjected to forces which are substantially perpendicular to one another, comprising:

a shaped elastomeric coherent mass of material having an elongated dimension that is perpendicular to the forces, and nonwoven elongated fibers dispersed in the coherent mass of material oriented in a direction perpendicular to the elongated dimension of the seal and substantially parallel to an applied compressive force and substantially perpendicular to a second resultant force, the compressive and resultant forces simultaneously creating a tendency for the seal to roll on an axis parallel with its elongated dimension and transverse to the compressive and resultant forces.

* * * * *